US011118242B2

(12) United States Patent
Ota et al.

(10) Patent No.: US 11,118,242 B2
(45) Date of Patent: Sep. 14, 2021

(54) HOT-PRESS MOLDING METHOD AND HOT-PRESS MOLDED PRODUCT

(71) Applicant: TOYOTA JIDOSHA KABUSHIKI KAISHA, Toyota (JP)

(72) Inventors: Eiichi Ota, Nagakute (JP); Yasuhiro Yogo, Nagakute (JP); Tomoaki Ihara, Toyota (JP); Shinobu Okuma, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 408 days.

(21) Appl. No.: 15/807,645

(22) Filed: Nov. 9, 2017

(65) Prior Publication Data

US 2018/0135147 A1 May 17, 2018

(30) Foreign Application Priority Data

Nov. 14, 2016 (JP) ..... JP2016-221952

(51) Int. Cl.
*C21D 9/48* (2006.01)
*C21D 1/22* (2006.01)
(Continued)

(52) U.S. Cl.
CPC ..... *C21D 9/48* (2013.01); *B21D 22/022* (2013.01); *B21D 22/208* (2013.01); *C21D 1/22* (2013.01);
(Continued)

(58) Field of Classification Search
None
See application file for complete search history.

(56) References Cited

U.S. PATENT DOCUMENTS 8,778,101 B2 * 7/2014 Ma ek ..... C21D 1/673 148/644
2012/0180910 A1 * 7/2012 Thomas ..... C21D 1/673 148/531
(Continued)

FOREIGN PATENT DOCUMENTS

CN 104668326 A 6/2015
EP 2546375 A1 1/2013
(Continued)

OTHER PUBLICATIONS

Kopeliovich, Dmitri. "Iron-carbon phase diagram", Jun. 1, 2012, SubsTech. http://www.substech.com/dokuwiki/doku.php?id=iron-carbon_phase_diagram (Year: 2012).*
(Continued)

*Primary Examiner* — Patricia L. Hailey
*Assistant Examiner* — Christopher D. Moody
(74) *Attorney, Agent, or Firm* — Sughrue Mion, PLLC

(57) ABSTRACT

A hot-press molding method of the present disclosure includes a first heating process in which a steel plate is heated and the entire steel plate becomes austenite, a first cooling process in which a cooling rate of the steel plate after the first heating process is partially changed, a first region which is a part of the steel plate is transformed into martensite, and a second region other than the first region remains as austenite, a second heating process in which the entire steel plate is reheated and the first region becomes tempered martensite, and a second cooling process in which the entire steel plate after the second heating process is cooled. At least one of the first cooling process and the second cooling process is performed during a molding process in which the steel plate is press-molded on a molding die.

4 Claims, 4 Drawing Sheets

(51) Int. Cl.
*B21D 22/20* (2006.01)
*B21D 22/02* (2006.01)
*C21D 1/673* (2006.01)

(52) U.S. Cl.
CPC ..... *C21D 1/673* (2013.01); *C21D 2211/001* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

2013/0037181 A1* 2/2013 Jin ..... C21D 8/0205
148/628
2013/0048161 A1* 2/2013 Matsuda ..... C21D 1/22
148/653
2013/0136945 A1* 5/2013 Charest ..... B21D 22/022
428/610
2013/0292009 A1* 11/2013 Hayashi ..... C21D 8/0226
148/518
2014/0295205 A1* 10/2014 Ota ..... B21D 22/208
428/600

FOREIGN PATENT DOCUMENTS

| | | | |
|---|---|---|---|
| EP | 3075872 | A1 | 10/2016 |
| JP | 62-211316 | A | 9/1987 |
| JP | 2011-174115 | A | 9/2011 |
| JP | 2012-144773 | A | 8/2012 |
| JP | 2016-41440 | A | 3/2016 |

OTHER PUBLICATIONS

Espacenet Translation of CN104668326 (Year: 2019).*

* cited by examiner

HOT-PRESS MOLDING METHOD AND HOT-PRESS MOLDED PRODUCT

INCORPORATION BY REFERENCE

The disclosure of Japanese Patent Application No. 2016-221952 filed on Nov. 14, 2016 including the specification, drawings and abstract is incorporated herein by reference in its entirety.

BACKGROUND

1. Technical Field

The present disclosure relates to a hot-press molding method and a hot-press molded product.

2. Description of Related Art

Press molded products are widely used in various fields such as automobiles and home appliances. In general, the press molded products are obtained by plastically deforming a metal plate interposed between a peripheral part of a die and a blank holder (also referred to as a "wrinkle holder") into a desired shape while extending or stretching the metal plate between a molding concave part of a die and a molding convex part of a punch. According to such press molding, effective mass production of members having complicated shapes is possible.

Particularly, in automobile fields and the like, in consideration of safety, the environment (low fuel consumption), and the like, lightweight hot-press molding with a higher strength is frequently used. Hot-press molding is, for example, a molding method in which a steel plate heated to an austenite region is press-molded using a mold (a die and a punch), and molding and a heat treatment are performed at the same time.

According to hot-press molding, since a workpiece (steel plate) is easily plastically deformed at a high temperature, high moldability is obtained and since molding and quenching are performed at the same time, a high strength (for example, a tensile strength is 1500 MPa or more) of a molded article is obtained. Here, hot-press molding is also referred to as hot pressing, hot stamping or the like.

Incidentally, a hot-press molded product (simply referred to as a "press molded product" or a "molded article") is generally quenched as a whole, and a high strength is likely to be maintained throughout the product. However, in one press molded product, required characteristics may differ according to parts thereof in many cases. For example, coexistence of a part for which a high strength is required and a part for which high ductility, high toughness, or the like is required rather than high strength may be necessary. Such a tendency becomes significant when the size of the press molded product is larger. Here, it is proposed to separately impart characteristics for each part (for example, a high strength part, a high ductility part, or a high toughness part) while using hot-press molding. Description thereof is shown in the following patent literature.

SUMMARY

In Japanese Unexamined Patent Application Publication No. 2011-174115 (JP 2011-174115 A), the entire steel plate having a specific composition is heated to an austenite region ($Ac_3$ point or more), and a cooling rate is then changed depending on parts. Therefore, a hot-press molded product having different strengths for each part (a rapidly cooled part and a gradually cooled part) are obtained.

In Japanese Unexamined Patent Application Publication No. 2012-144773 (JP 2012-144773 A), a steel plate partially having black marks having excellent thermal radiation absorbability is heated through radiant heat transfer, a temperature distribution is imparted to the steel plate in advance, and the steel plate is then rapidly cooled. Therefore, a hot-press molded product having a different strength part is obtained.

The present disclosure provides a hot-press molding method through which a hot-press molded product having different characteristics depending on parts is obtained, which is a method different from that in the related art, and a hot-press molded product having characteristics different from those in the related art.

The inventors have conducted extensive research to solve the problems, and as a result, a press molded product partially quenched is reheated, the entire product is press-molded again, and thus a hot-press molded product having different characteristics (such as a strength and a hardness) for each part is successfully obtained. According to development of this achievement, the present disclosure to be described below has been completed.

<Hot-Press Molding Method>

(1) A first aspect of the present disclosure relates to a hot-press molding method including a first heating process in which a steel plate is heated and the entire steel plate becomes austenite, a first cooling process in which a cooling rate of the steel plate after the first heating process is partially changed, a first region which is a part of the steel plate is transformed into martensite and a second region other than the first region remains as austenite, a second heating process in which the entire steel plate is reheated and the first region becomes tempered martensite, and a second cooling process in which the entire steel plate after the second heating process is cooled, wherein at least one of the first cooling process and the second cooling process is performed during a molding process in which the steel plate is press-molded on a molding die.

According to the hot-press molding method (simply referred to as a "molding method") of the present disclosure, a hot-press molded product (simply referred to as a "molded article") having different characteristics (metal structures) depending on parts is obtained as will be described below.

First, the structure of the entire steel plate becomes austenite in the first heating process and then the first region is rapidly cooled (quenched) into martensite in the first cooling process. On the other hand, the second region is gradually cooled or slowly cooled and remains as austenite (including supercooled austenite at an $A_1$ point or lower and above an Ms point). In this case, as a matter of course, immediately after the first cooling process, the first region is brought into a low temperature state below the Ms point (martensite transformation start temperature), and the second region is brought into a high temperature state above the Ms point.

Next, in the second heating process, the steel plate after the first cooling process is reheated. Thus, martensite in the first region is tempered and becomes tempered martensite. On the other hand, the second region which is in a state of being at a higher temperature than the first region after the first cooling process remains as austenite after the second heating process. However, at least a part of the austenite may be transformed into ferrite (simply referred to as "F"), pearlite (simply referred to as "P"), bainite (simply referred to as "B"), or the like.

Whether the structure of the second region remains as austenite or is changed (transformed) from austenite depends on the temperature of the second region after the second heating process and a temperature raising process (particularly a heating time). For example, in the second heating process, the second region that is rapidly heated to above the $A_1$ point readily remains as austenite. However, when it remains for a long time (about several minutes) below the $A_1$ point, at least a part of austenite in the second region is likely to be become ferrite, pearlite, bainite, or the like.

Further, in the second cooling process, the steel plate reheated in this manner is cooled (particularly rapidly cooled). Accordingly, the first region becomes stable tempered martensite, and the second region becomes a structure corresponding to a state after the second heating process. For example, the second region which is in an austenite state after the second heating process may be quenched in the second cooling process and become martensite. On the other hand, the second region that has been changed from austenite after the second heating process has another stable structure (a single phase structure or a multi-phase structure such as ferrite, pearlite or bainite) after the second cooling process.

Then, at least one of the first cooling process and the second cooling process described above is performed during a molding process in which the steel plate is press-molded on a molding die. Therefore, it is possible to change characteristics and impart shapes for each part. For example, a molded article having a desired shape in which a high strength part (hard part), a high toughness part, or a high ductility part (soft part) coexist may be obtained.

Here, the tempered martensite of the first region described above may become a hard part having a high hardness or a soft part having a lower hardness than the hard part according to the structure of the second region. For example, when the second region becomes martensite, the first region may become softer (higher toughness and ductility) tempered martensite than the second region. On the other hand, when the second region becomes ferrite, pearlite or bainite, the first region may become harder (higher strength) tempered martensite than the second region.

<Hot-Press Molded Product>

Based on the molding method described above, the present disclosure can be understood as the following novel molded article that is different from that in the related art.

A second aspect of the present disclosure relates to a hot-press molded product including a first region having tempered martensite and a second region having martensite.

In addition, a third aspect of the present disclosure relates to a hot-press molded product including a first region having tempered martensite and a second region having at least one of ferrite, pearlite, and bainite (a single structure or a complex structure).

A difference between the first region and the second region can be understood as not only a difference between the above structures but also, for example, a hardness difference which is an index value representing a characteristic. Specifically, the hard to soft ratio (Hh/Hs) which is a ratio of the maximum hardness (Hh) to the minimum hardness (Hs) in areas of the first region and the second region may be 1.3 or more, 1.5 or more, 1.8 or more, or further 2 or more.

In addition, a hot-press molded product of the present disclosure may be understood using a hardness difference instead of the hard to soft ratio or together with the hard to soft ratio. Specifically, in the present disclosure, in areas of the first region and the second region, the hardness difference (Hh−Hs) which is a difference between the maximum hardness (Hh) and the minimum hardness (Hs) may be 100 HV or more, 130 HV or more, 170 HV or more, 200 HV or more, and 300 HV or more.

The tempered martensite referred to in the present disclosure is a structure obtained by tempering quenched martensite (Full martensite/simply referred to as "Full M") obtained by rapidly cooling austenite at an Ms point or lower, and further an Mf point (martensite transformation completion temperature) or lower at a temperature below the $A_1$ point. Therefore, the tempered martensite referred to in the present disclosure is not limited to tempered martensite in a narrow sense obtained by performing tempering at a low temperature (for example, 150 to 250° C.) and also includes troostite obtained by performing tempering at an intermediate temperature (for example, 400 to 550° C.), sorbite obtained by performing tempering at a high temperature (for example, 550 to 650° C.) near the $A_1$ point, and the like.

Soft (high toughness and ductility) tempered martensite is obtained by tempering martensite (Full M) at a relatively high temperature, and preferably includes mainly, for example, sorbite. On the other hand, hard (high strength) tempered martensite is obtained by tempering martensite (Full M) at a relatively low temperature, and may include, for example, mainly troostite or tempered martensite in a narrow sense.

Here, since both the quenched martensite (Full M) and the tempered martensite are in a martensite phase, it is not easy to distinguish between the two using only structure photographs. However, it is possible to distinguish between the two when precipitation of carbides and the like is observed.

<Others>

Unless otherwise specified, the "temperature" in this specification refers to a temperature of the steel plate or each of the regions. A specific temperature is specified and measured using a thermocouple welded to a side surface of the steel plate. As a temperature of each region, a temperature measured at the center of each region is used as a representative value. Simply, a temperature obtained by arithmetically averaging the maximum temperature and the minimum temperature obtained from a temperature distribution obtained by measuring the region using a radiation thermometer may be used as the temperature of the region.

Transformation temperatures (an $A_1$ point, an $A_3$ point, an Mf point, an Ms point, and the like) of the steel plate are physical property values determined according to a composition of components of the steel plate. Strictly speaking, the transformation temperatures are different for a temperature raising process (heating process) and a temperature lowering process (cooling process). Thus, a suffix "c" (temperature raising process, heating process) and a suffix "r" (temperature lowering process, cooling process) are appropriately added to temperatures. However, as long as there can be no misunderstanding, in this specification, the temperatures are simply denoted without adding "c" or "r."

In this specification, regardless of the temperature raising process or the temperature lowering process, "below" a certain temperature means a temperature lower than the temperature and "exceeding" a certain temperature means a temperature higher than the temperature.

The existence or area of the regions in this specification can be substantially specified with a focus on trends in structure and hardness distributions. Here, it is not always easy to strictly determine the extension and boundary of each region and this is not particularly important in understanding the present disclosure. Purposely, regions having a hardness difference of 100 HV or more may be set as the first region and the second region in the present disclosure.

A metal structure (phase) after molding can be determined based on a microscopic image obtained by observing a target part (region) exposed by corrosion with nital under a scanning electron microscope (SEM). A metal structure during molding can be determined based on a composition of the steel plate and a temperature of the target region.

Unless otherwise specified, "x to y" used in this specification includes a lower limit value x and an upper limit value y. Various numerical values shown in this specification or any numerical value included in a numerical range may be used to set a range of "a to b" with a new lower limit value and upper limit value.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1A:
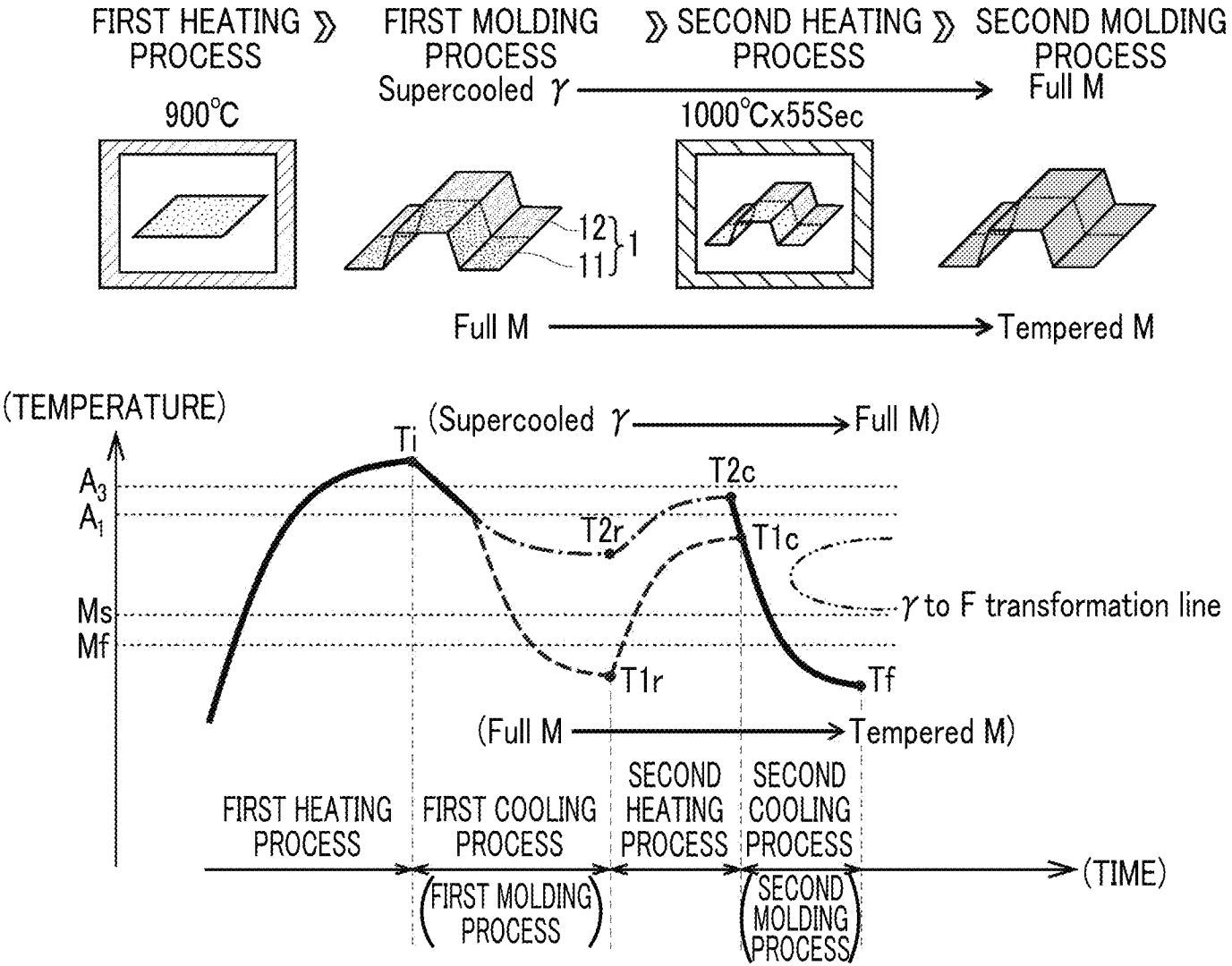
FIG. 1A is a schematic diagram showing processes of a molding method of a first example (first pattern) and temperature change in the processes.

One or more listed items arbitrarily selected from this specification may be components of the present disclosure. The content described in this specification may correspond to not only a molding method but also a molded article. The content described for "method" may be components for "product." The best embodiment may differ according to objects, required performance, and the like.

<Steel Plate>

A steel plate according to the present disclosure is made of an iron alloy containing carbon (C), and may be a stainless steel plate (in particular, a martensite stainless steel plate) as long as it can be quenched in addition to a carbon steel plate and an alloy steel plate. Theoretically, C may be contained in a range of 0.02 mass % (simply referred to as "%" appropriately) which is a solid solution upper limit of ferrite ($\alpha$) to 2.14% which is a solid solution upper limit of austenite ($\gamma$). However, in consideration of moldability, a strength, a toughness, and the like, when the entire steel plate is set to 100%, there is preferably 0.1 to 0.6% of C and more preferably 0.15 to 0.4%.

In addition, the steel plate preferably contains an alloy element (such as Mn, Cr, B or Mo) for enhancing hardenability. In this case, for example, there is preferably 0.5 to 3%, and more preferably 1 to 2.5% of manganese (Mn). The Cr concentration is preferably 0.05 to 3%, and more preferably 0.1 to 1%. The boron (B) concentration is preferably 0.001 to 0.01%. Of course, in addition to such alloy elements, according to specifications of a molded article, an element such as silicon (Si) and aluminum (Al) may be contained in an amount of preferably 0.001 to 0.5% and more preferably about 0.02 to 0.05%.

Here, the thickness (plate thickness) of the steel plate may be appropriately selected according to specifications of a press molded product. However, in consideration of a heat treatment (quenching and tempering), molding, and the like, 4 mm or less, 3 mm or less, or 2 mm or less is preferable and 1.5 mm or less is more preferable. The lower limit value is not limited. However, in order to ensure a rigidity, a strength, and the like of a press molded product, 0.3 mm or more or 0.6 mm or more is preferable, and 1 mm or more is more preferable.

<First Heating Process>

The first heating process is a process of heating the entire steel plate to an austenite (state or phase) before molding or quenching. Specifically, the first heating process may be a process of heating the entire steel plate to an initial temperature (Ti) that is equal to or higher than an austenite transformation completion temperature ($Ac_3$ point). Ti is, for example, 850 to 950° C.

<First Cooling Process>

The first cooling process is a process of cooling the steel plate in the austenite state, transforming a first region which is a part thereof into a martensite state, and maintaining a second region which is the other part thereof in the austenite state. Specifically, the first cooling process is a process of rapidly cooling the first region and gradually cooling or slowly cooling the second region, and partially changing a cooling rate of the heated steel plate.

When the first cooling process is performed as press molding, rapid cool of the first region is performed by bringing, for example, the first region of the steel plate, into direct contact with a molding surface of a molding die (mold).

When the first cooling process is performed as press molding, gradual cooling or slow cooling of the second region is performed, for example, by preventing the second region of the steel plate from coming into contact with a molding surface of the molding die (mold). When the second region is brought into contact with the molding surface of the mold, a structure (for example, imparting an uneven pattern) for reducing heat transferability is provided on the molding surface, and a temperature adjustment unit such as a heater may be built into the vicinity of the molding surface.

Here, the cooling rate of rapid cooling in this specification is assumed to be, for example, 10 to 300° C./sec. In addition, the cooling rate of gradual cooling or slow cooling is assumed to be, for example, 1 to 30° C./sec. A preferable range of the cooling rate may be determined based on, for example, a continuous cooling transformation line diagram (CCT diagram) corresponding to various steel plates and a continuous cooling curve.

<Second Heating Process>

The second heating process is a process of reheating the (entire) steel material after the first cooling process and tempering at least martensite in the first region. When a heating temperature, a rate of temperature increase, a retention time or the like at this time is adjusted, it is possible to control structures of the regions. For example, the following two patterns are conceivable.

(1) First Pattern

The steel plate is reheated so that the temperature of the first region is less than an $A_1$ point and the temperature of the second region is the $A_1$ point or more. When the steel plate is rapidly cooled in a subsequent second cooling process, the second region is quenched and becomes martensite. Here, martensite in the first region is rapidly cooled from below (immediately below) the $A_1$ point and becomes tempered martensite.

Here, when the temperature rise in the second region is slow, a part of austenite in the second region may be transformed into ferrite, pearlite, or the like. In this case, as long as the second region is not reheated to an $A_3$ point or more, the entire second region does not become austenite, and even if the second region is rapidly cooled, the entire second region cannot become completely martensite. Here, the second heating process is preferably a process in which rapid heating is performed for a short time. For example, a heating time from when heating starts until heating is completed is preferably 10 to 240 seconds, 30 to 120 seconds, and more preferably about 45 to 90 seconds.

(2) Second Pattern

The first region and the second region are reheated to a temperature below the $A_1$ point. In this case, the temperature gently increases or the first region and the second region are maintained at a desired temperature for a predetermined time. Accordingly, martensite in the first region is sufficiently tempered and austenite in the second region may be sufficiently transformed into ferrite, pearlite, or the like. Here, in the second heating process, a heating time from when heating starts until heating is completed is preferably 1 to 12 minutes and more preferably 2 to 6 minutes.

Here, when the first region and the second region are rapidly heated to a temperature below the $A_1$ point and then rapidly cooled in the second cooling process, even if characteristics (such as a hardness) are different, a structure (the first region has tempered martensite and the second region has martensite) having the same trends as in the first pattern is obtained.

<Second Cooling Process>

The second cooling process is a process of re-cooling the (entire) steel plate reheated in the second heating process. When a cooling rate in the second cooling process is adjusted, it is possible to control structures of the regions in cooperation with the second heating process. However, generally, in order to prevent embrittlement, cracks, and the like, rapid cooling is performed in the second cooling process. In such a second cooling process, press molding (molding process) is preferably performed. When the entire surface of the steel plate that is held in the molding die is rapidly cooled, it is possible to impart different characteristics for each part, and it is possible to obtain a molded article having excellent dimensional accuracy.

<Press Molded Product>

The press molded product of the present disclosure, regardless of its form and application, may be used as, for example, a vehicle body, a bumper, an oil pan, an inner panel, a pillar, a wheel house, and the like. Here, in the press molded product of the present disclosure, further application of another heat treatment is not excluded.

The present disclosure will be described in detail with reference to production and evaluation of a hot-press molded product.

<Press Molding Device (Mold)>

A hot-press molding device (simply referred to as a "molding device" or a "mold") including a die having a molding concave part, a punch having a molding convex part loosely fitted thereto, a blank holder disposed to face the die, a die cushion that is vertically movable and supports the blank holder, a base supporting the die cushion, and a hydraulic press machine for driving the die was prepared. Here, in the molding device, the punch was fixed to the base.

The die included a molding concave part having a groove shape that extended in one direction. The die included a first mold part (corresponding to first regions 11 and 21/refer to FIG. 1A and FIG. 2A) and a second mold part (corresponding to second regions 12 and 22/refer to FIG. 1A and FIG. 2A) which had approximately the same length in the extension direction. An insulating material was interposed between the first mold part and the second mold part.

A water channel through which cooling water for rapidly cooling at least a workpiece passed was disposed in the first mold part. An electrothermal heater configured to adjust a cooling rate of at least a workpiece was disposed in the second mold part in addition to the water channel. In addition, the first mold part and the second mold part included a thermocouple (temperature detection unit) configured to detect a molding temperature (particularly, a temperature near a surface that was in contact with the steel plate) of each part and a control device (temperature control unit) configured to adjust an amount of cooling water supplied to the water channel, an amount of electrical energy supplied to the electrothermal heater, and the like according to the detection results.

<Workpiece>

A commercially available steel plate for hot-press molding was prepared. The steel plate had a composition of C: 0.19 mass %, Mn: 2.0 mass %, Cr: 0.25 mass %, and the remainder: Fe and inevitable impurities. Here, the steel plate had an $A_3$ point of 820° C., an $A_1$ point of 730° C., an Ms point of 360° C., and an Mf point of 280° C. These temperatures were specified by measuring a change in volume caused by phase transformation. In addition, an initial hardness of the steel plate was 190 HV.

<Hot-Press Molding/First Example>

[Production of Sample]

Hot-press molding (first pattern) was performed as shown in FIG. 1A. Processes will be described in detail below. Here, in FIG. 1A, a temperature change (thermal history) of a first region 11 and a second region 12 of a steel plate 1 generated in the processes is also shown. Temperatures of parts were measured when the thermocouple was welded to a side surface of the steel plate. In addition, FIG. 1A shows a structure of the steel plate 1 generated in the processes with the following notation.

γ: austenite, Supercooled γ: supercooled austenite, M: martensite, Full M: quenched martensite, Tempered M: tempered martensite, F: ferrite, P: pearlite (1) First Heating Process The steel plate 1 was put into a heating furnace (first heating furnace), and the entire steel plate 1 was heated to an initial temperature (Ti) which was the $Ac_3$ point or more. Here, in the present example, Ti=900° C.

(2) First Molding Process (First Cooling Process)

The steel plate removed from the heating furnace was immediately placed in the molding device described above and was subjected to press molding. In this case, temperatures of a first mold part and a second mold part of a mold (first molding die) were independently controlled, and a temperature (T1) of the first region 11 and a temperature (T2) of the second region 12 were changed as shown in FIG. 1A. Specifically, the first region 11 which was a part of the heated steel plate 1 was cooled to a first cooling temperature (T1*r*) which was the Mf point or lower. In addition, the second region 12 which was the other part of the steel plate 1 was cooled to a second cooling temperature (T2*r*) which was lower than an $Ar_1$ point and higher than the Ms point. Here, in the present example, T1*r*=100° C., T2*r*=580° C.

In this manner, the first region 11 was brought into substantially a full martensite (Full M) phase, and the second region 12 was brought into a supercooled austenite (supercooled γ) phase. Here, in the present process, both the first region 11 and the second region 12 were brought into direct contact with the mold and then molded. In this case, the first region 11 was brought into contact with the first mold part that was cooled with water and rapidly cooled, and the second region 12 was brought into contact with the second mold part that was preheated to a predetermined temperature and gradually cooled (slow cooled). In this case, a molding time (contact time) of the steel plate 1 using the mold was 10 to 20 seconds.

(3) Second Heating Process

The steel plate 1 molded to a desired shape in the first molding process was quickly removed from the mold, and was immediately put into a heating furnace (second heating furnace). A temperature in the furnace at this time was 1000° C., and a retention time was 55 seconds.

The entire steel plate 1 cooled in the first molding process (first cooling process) in this manner was reheated quickly. Thus, the first region 11 was heated to a first heating temperature (T1*c*) below an $Ac_1$ point, tempered, and became martensite (Tempered M). On the other hand, the second region 12 which was in a state of being at a higher temperature than the first region 11 before the present process was heated to a second heating temperature (T2*c*) which was the $Ac_1$ point or more, and the entire second region 12 remained as austenite. Here, in the present example, T1*c*=680° C., T2*c*=840° C.

(4) Second Molding Process (Second Cooling Process)

The steel plate removed from the heating furnace was immediately placed in the molding device described above and was subjected to press molding again. In this case, both the first mold part and the second mold part of the mold (second molding die) were sufficiently cooled.

The entire steel plate 1 reheated in the second heating process in this manner was rapidly cooled to a final temperature (Tf) which was the Mf point or lower. Thus, a hot-press molded product including the first region 11 having stable tempered martensite and the second region 12 having (quenched) martensite (Full M) phase-transformed from austenite was obtained. Here, in the present example, Tf was set as room temperature.

[Measurement of Sample]

Figure 1B:
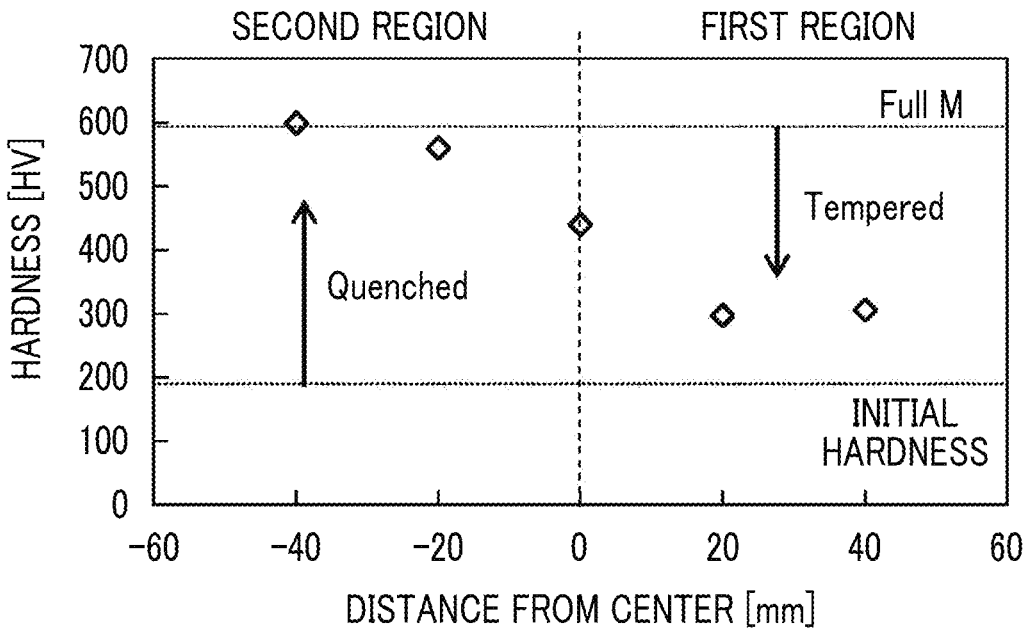
FIG. 1B is a dispersion diagram showing a hardness distribution of a molded article according to the first example.

Results obtained by measuring the Vickers hardness of the parts of the molded article described above are shown in FIG. 1B. As can be clearly understood from FIG. 1B, it was confirmed that the first region 11 was relatively soft and the second region 12 was relatively hard. In other words, a hot-press molded product in which parts having hardnesses (or structures) that were sufficiently different were coexisting was obtained.

Specifically, the minimum hardness (Hs) in the first region 12 was about 300 HV, and the maximum hardness (Hh) in the second region 11 was about 600 HV. That is, the hard to soft ratio (Hh/Hs) between both was about 2, and the hardness difference was about 300 HV.

<Hot-Press Molding/Second Example>

[Production of Sample]

Figure 2A:
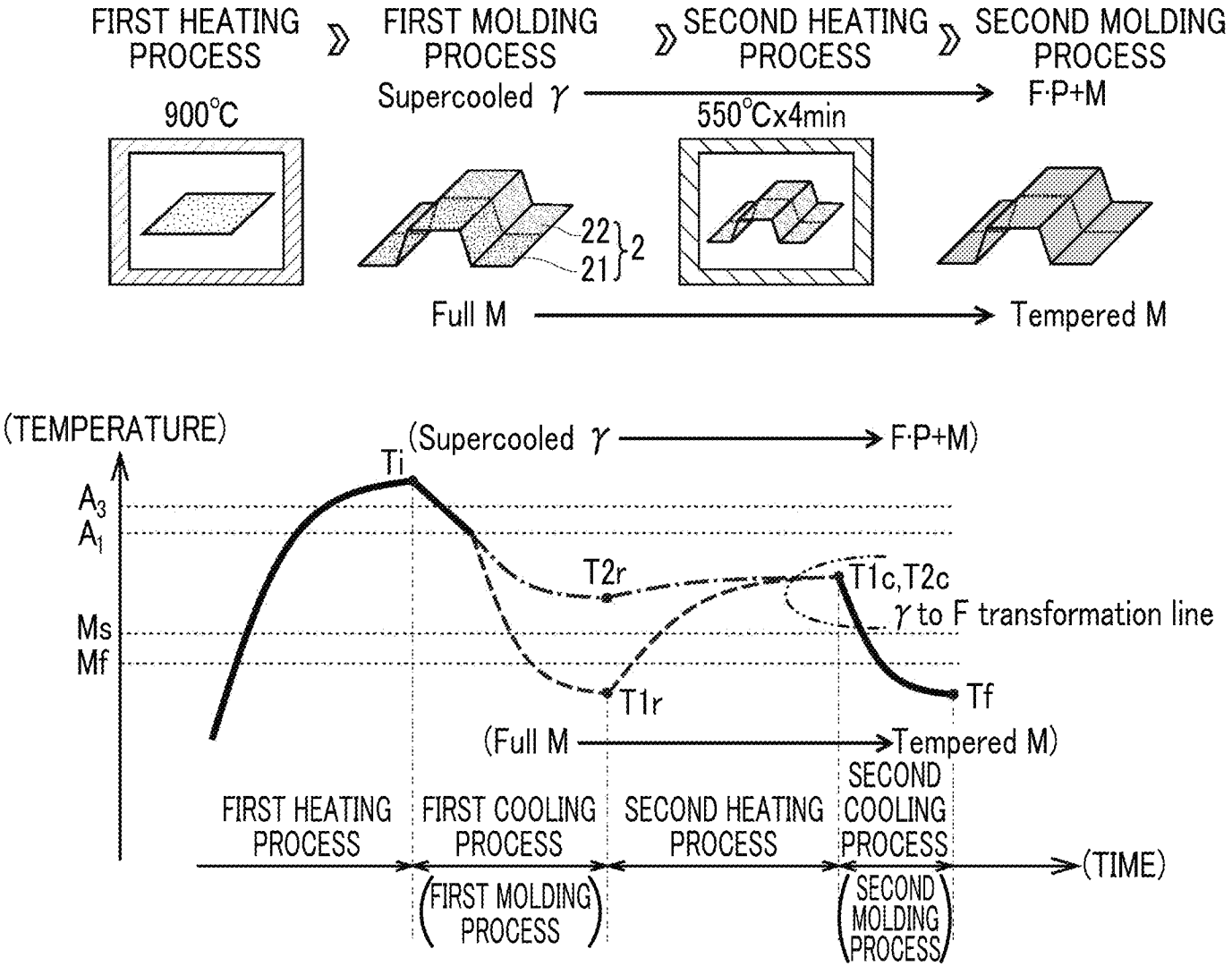
FIG. 2A is a schematic diagram showing processes of a molding method of a second example (second pattern) and temperature change in the processes.

Hot-press molding (second pattern) was performed as shown in FIG. 2A. Processes will be described in detail below. In FIG. 2A, a temperature change (thermal history) of a first region 21 and a second region 22 of a steel plate 2 generated in the processes are also shown. Here, description of the same content as in the first example will be appropriately omitted and simplified.

(1) In the same manner as in the first example (first pattern), the first heating process and the first molding process (first cooling process) were performed.

(2) Second Heating Process

The steel plate 2 molded to a desired shape in the first molding process was removed from the mold and put into a heating furnace (second heating furnace). A temperature in the furnace at this time was 550° C., and a retention time was 4 minutes. Thus, the entire steel plate 2 cooled in the first molding process (first cooling process) was reheated. Thus, the second region 22 was heated to a second heating temperature (T2*c*) below the $Ac_1$ point. On the other hand, the first region 21 which was in a state of being at a lower temperature than the second region 22 before the present process was also heated to the first heating temperature (T1*c*) below the $Ac_1$ point. However, in the present process, since the steel plate 2 was held in the furnace at a temperature which was not very high for a relatively long time, temperatures of the first region 21 and the second region 22 were substantially the same (T1*c*≈T2*c*). Here, in the present example, T1*c*(≈T2*c*)=550° C.

In this case, since the first region 21 was tempered at a temperature that was not so high, it became harder tempered martensite (Tempered M) than that of the first example. On the other hand, since the second region 22 remained at below the $A_1$ point as described above for a long time, it was transformed from austenite (γ) into ferrite (F). This transformation can be seen from the fact that a temperature change line of the second region 22 crossed a transformation line (γ to F transformation line) as shown in FIG. 2A. In this case, C solid-solutionized in austenite in the second region 22 was precipitated as cementite θ ($Fe_3C$), and a structure of pearlite (P) or bainite (B) was generated by θ and F.

(3) In the same manner as in the first example (first pattern), the second molding process (the second cooling process) was performed. Thus, a hot-press molded product including the first region 21 having stable and hard tempered martensite and the second region 22 having a mixed structure of ferrite phase-transformed from austenite, and pearlite (P) or bainite (B) was obtained.

[Measurement of Sample]

Figure 2B:
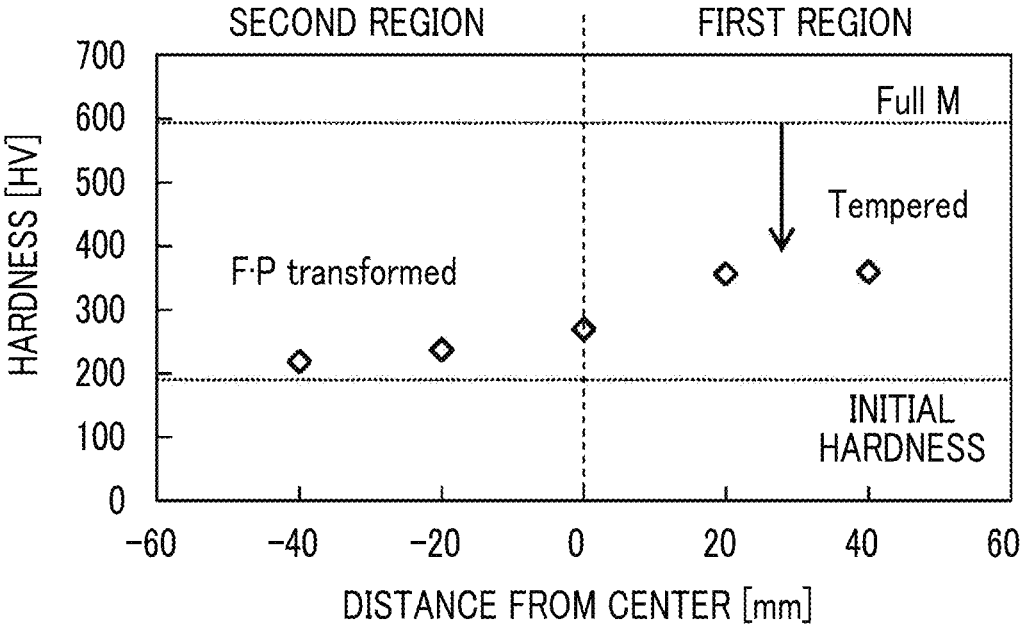
FIG. 2B is a dispersion diagram showing a hardness distribution of a molded article according to the second example.

Results obtained by measuring the Vickers hardness of the parts of the molded article described above are shown in FIG. 2B. As can be clearly understood from FIG. 2B, unlike the first example, it was confirmed that the first region 21 was hard and the second region 22 was soft. Specifically, the maximum hardness (Hh) in the first region 21 was about 360 HV, and the minimum hardness (Hs) in the second region 22 was about 220 HV. Accordingly, the hard to soft ratio (Hh/Hs) between both was about 1.6, and the hardness difference was about 140 HV. As a result, in the present example also, a hot-press molded product in which parts having hardnesses (or structures) that were sufficiently different were coexisting was obtained.

As can be understood from the first example and the second example, it was confirmed that it was possible to obtain a molded article having different characteristics (such as a hardness and a strength) depending on parts, and it was possible to adjust characteristics (such as a hardness) of the parts, dispositions thereof, and the like by changing heat treatment processes thereof.

What is claimed is:

1. A hot-press molding method comprising:

a first heating process in which a steel plate is heated and the entire steel plate becomes austenite;

a first cooling process in which a cooling rate of the steel plate after the first heating process is different in a first region of the steel plate and a second region of the steel plate, the first region is cooled below a martensite transformation completion temperature, and the first region is transformed into martensite and the second region other than the first region remains as austenite, wherein the first cooling process is performed during a molding process in which the steel plate is press-molded on a molding die to obtain a molded article;

a second heating process in which the entire molded article is reheated, the first region is heated to a temperature lower than an austenite transformation start temperature so the first region becomes tempered martensite, and the second region is heated to a temperature above the austenite transformation start temperature so the second region remains austenite; and a second cooling process in which the entire molded article after the second heating process is cooled, and the second region is transformed into martensite.

2. The hot-press molding method according to claim 1, wherein, in the second heating process, a heating time from when heating starts until heating is completed is 10 to 240 seconds.

3. The hot-press molding method according to claim 1, wherein the second cooling process is performed during a molding process in which the entire molded article is press-molded on a molding die.

4. The hot-press molding method according to claim 1, wherein during the second cooling process the second region is cooled to a temperature lower than the austenite formation temperature and higher than the martensite transformation completion temperature.

* * * * *